US006702422B1

(12) United States Patent
Suzuki et al.

(10) Patent No.: US 6,702,422 B1
(45) Date of Patent: Mar. 9, 2004

(54) INK JET COLOR RECORDING APPARATUS AND METHOD FOR RECOVERING INK JET NOZZLE

(75) Inventors: Takashi Suzuki, Ebina (JP); Tatsuhiro Ishize, Ebina (JP); Takaaki Sekiyama, Ebina (JP)

(73) Assignee: Fuji Xerox Co. Ltd., Tokyo (JP)

( * ) Notice: Subject to any disclaimer, the term of this patent is extended or adjusted under 35 U.S.C. 154(b) by 0 days.

(21) Appl. No.: 09/722,075

(22) Filed: Nov. 27, 2000

(30) Foreign Application Priority Data

Mar. 10, 2000 (JP) ..... 2000-065974

(51) Int. Cl.[7] ..... B41J 2/165
(52) U.S. Cl. ..... 347/24; 347/29; 347/30
(58) Field of Search ..... 347/22, 24, 29, 347/30, 33, 35, 36, 100

(56) References Cited

U.S. PATENT DOCUMENTS 5,712,668 A * 1/1998 Osborne et al. ..... 347/32
5,810,917 A * 9/1998 Yamazaki et al. ..... 106/31.58
5,896,143 A * 4/1999 Matsui et al. ..... 347/24

FOREIGN PATENT DOCUMENTS

JP 10-67121 3/1998

* cited by examiner

*Primary Examiner*—Shih-Wen Hsieh
(74) *Attorney, Agent, or Firm*—Morgan Lewis & Bockius LLP

(57) ABSTRACT

The invention provides an ink jet color recording apparatus capable of forming a good image by preventing solidification of ink. The ink jet color recording apparatus has a recovery step of recovering the injection function of a black nozzle by recovering black ink (pigment ink) remaining in the black nozzle into a black cap, and a supply step of supplying color ink (dye ink) to the black cap after the recovery step. Thus, the pigment ink recovered into the black cap by the recovery step can be made into mixed ink hard to dry, and further ink adhering to the inner wall of a suction hose connected to the black cap can be made into mixed ink residue hard to dry.

8 Claims, 13 Drawing Sheets

INK JET COLOR RECORDING APPARATUS AND METHOD FOR RECOVERING INK JET NOZZLE

BACKGROUND OF THE INVENTION

1. Field of the Invention

This invention relates to a small-sized ink jet color recording apparatus adapted to fly ink to a recording medium by an ink jet method to form a color image.

2. Description of the Related Art

As shown in FIG. 11, the conventional ink jet color recording apparatus 80 is so constructed that a recording head 82 (hereinafter simply referred to as head 82) is reciprocated along a guide 84 and with recording paper P transported in the direction U intersecting perpendicularly to the reciprocating direction W of the head, dye ink is flown according to the image information to form an image.

As shown in FIG. 12, the head 82 is provided with a storing part 86B for storing black ink, a storing part 86C for storing color ink, a nozzle 88B for discharging black ink, and a nozzle 88C for discharging color ink.

As the nozzles 88B, 88C have a small diameter, ink is dried to easily cause clogging. Therefore, frequently the ink is jammed not to be flown so that a desired image cannot be formed. As a countermeasure, generally, a maintenance part 89 (see FIGS. 11 and 12) having a suction system is provided, whereby when the image quality is lowered, ink in the nozzles 88B, 88C is sucked and removed to recover the injection function of the nozzles 88B, 88C.

The inventors have, as shown in FIG. 13, invented an ink jet color recording apparatus 90 adapted to suck ink by one small-sized suction pump 92 and filed an application for it. The contents of the invention are disclosed in Japanese Published Unexamined Patent Application No. Hei 10-067121.

The apparatus 90 is provided with a cap member 94B corresponding to the nozzle 88B and a cap member 94C corresponding to the nozzle 88C. Hoses 96B, 96C as an ink suction path are respectively connected to the bottoms of the cap members 94B and 94C, and the other ends of the hoses 96B, 96C are respectively connected to a first suction port 98 and a second suction port 99 of the suction pump 92.

The ink jet color recording apparatus 90 is so constructed that suction of the nozzle 88B and suction of the nozzle 88*c* are individually performed by the small-sized suction pump 92.

Recently, however, ink (pigment ink) mainly including pigment ingredients has been used to strengthen the water resisting property of ink. The pigment ink is more liable to dry than the dye ink used heretofore. Consequently, it has a disadvantage in that ink is solidified in the cap members 94B, 94C, so ink in the nozzles 88B, 88C is not sufficiently removed. Further, in sucking, ink adheres to the inner wall or the like of the hoses 96B, 96C to become solid ink residue 100, which results in the disadvantage that the function of the maintenance part 89 is not exhibited sufficiently.

SUMMARY OF THE INVENTION

The present invention has been made in view of the above circumstances and provides an ink jet color recording apparatus capable of forming a favorable image by preventing solidification.

According to an aspect of the present invention, the ink jet color recording apparatus has plural ink tanks for respectively storing ink different in composition; plural recording heads each having a nozzle for injecting ink in the ink tanks; and a cap member for recovering ink in the nozzle, wherein the ink jet color recording apparatus comprises: a recovery step of recovering the injection function of the nozzle by recovering ink in the nozzle into the cap member; and the supply step of supplying ink different in composition from the ink in the nozzle to the same cap member after the recovery step.

The ink in the nozzle is recovered into the cap member by the recovery step. Then, ink different in composition from the ink is supplied to the same cap member by the supply step to mix the ink in the cap member.

Thus, the ink recovered in the cap member is made into the mixed ink hard to dry so that the ink is hard to be solidified.

According to another aspect of the invention, the ink jet color recording apparatus is characterized in that ink of different compositions is pigment ink and dye ink.

The pigment ink which is easy to dry so that it is liable to be solidified is mixed with the dye ink in the cap member so that the density is lowered. Thus, the ink is made into mixed ink hard to dry, that is, hard to be solidified.

According to another aspect of the invention, the ink jet color recording apparatus is characterized in that the recovery step is the step of sucking ink from the nozzle.

This suction is frequently performed when an abnormal image is formed.

The injection function of the nozzle can be surely recovered.

In the ink jet color recording apparatus of the invention, however, when the recovery step is performed, sometimes ink adheres to the inner wall of the suction system used in suction and such adhering ink (hereinafter referred to as adhering ink) is easy to dry. Accordingly, after the supply step, the suction step of sucking ink staying in the cap member is performed, whereby the staying ink and the adhering ink are mixed so that the composition of the adhering ink is made into mixed ink hard to dry so as to sufficiently secure the sucking force of the suction system.

According to another aspect of the invention, the ink jet color recording apparatus is characterized in that the recovery step is the step of blank-injecting ink from the nozzle.

This blank injection is often performed periodically.

After the supply step performed after the recovery step, the suction step of sucking ink staying in the cap member may be performed. Thus, the mixed ink staying in the cap member can be immediately removed.

According to another aspect of the invention, the method for recovering ink-jet recording head having the following steps: vacuuming a pigment-base liquid ink form a nozzle into a cap member having a ink guide tube (hose);and supplying a dye-base liquid ink into the ink guide tube through the cap member.

According to another aspect of the invention, the ink-jet recording apparatus having a recording head having a nozzle for injecting an pigment-base ink; a cap member for recovering the ink in the nozzle; an ink guide tube (hose) connected to the cap member; and an ink supplying device that supply a dye-base ink into the ink guide tube through the cap member.

The ink supplying device may be a second recording head having the dye-base ink.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
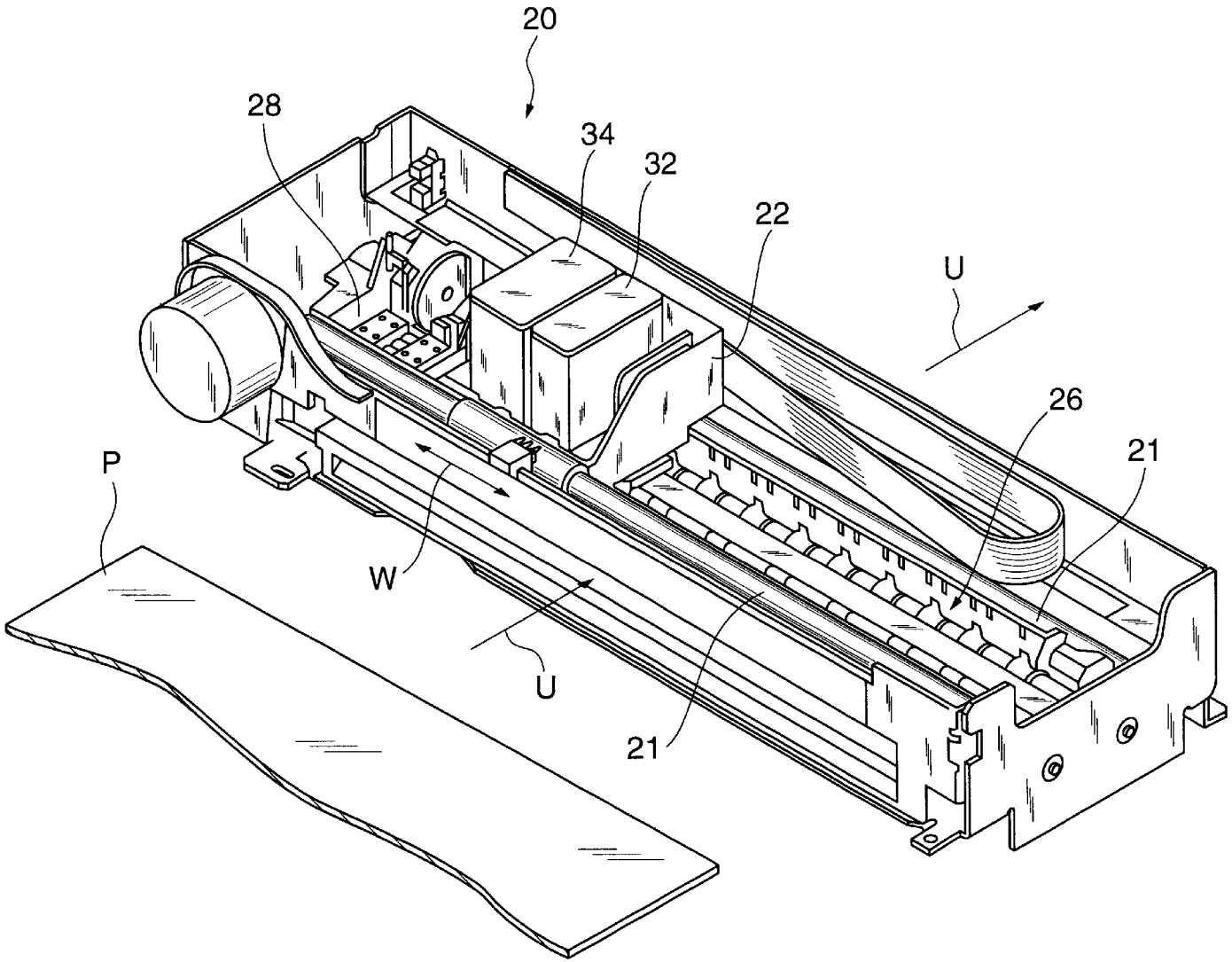
FIG. 1 is a perspective view of an ink jet color recording apparatus according to a first embodiment of the invention.
Figure 2:
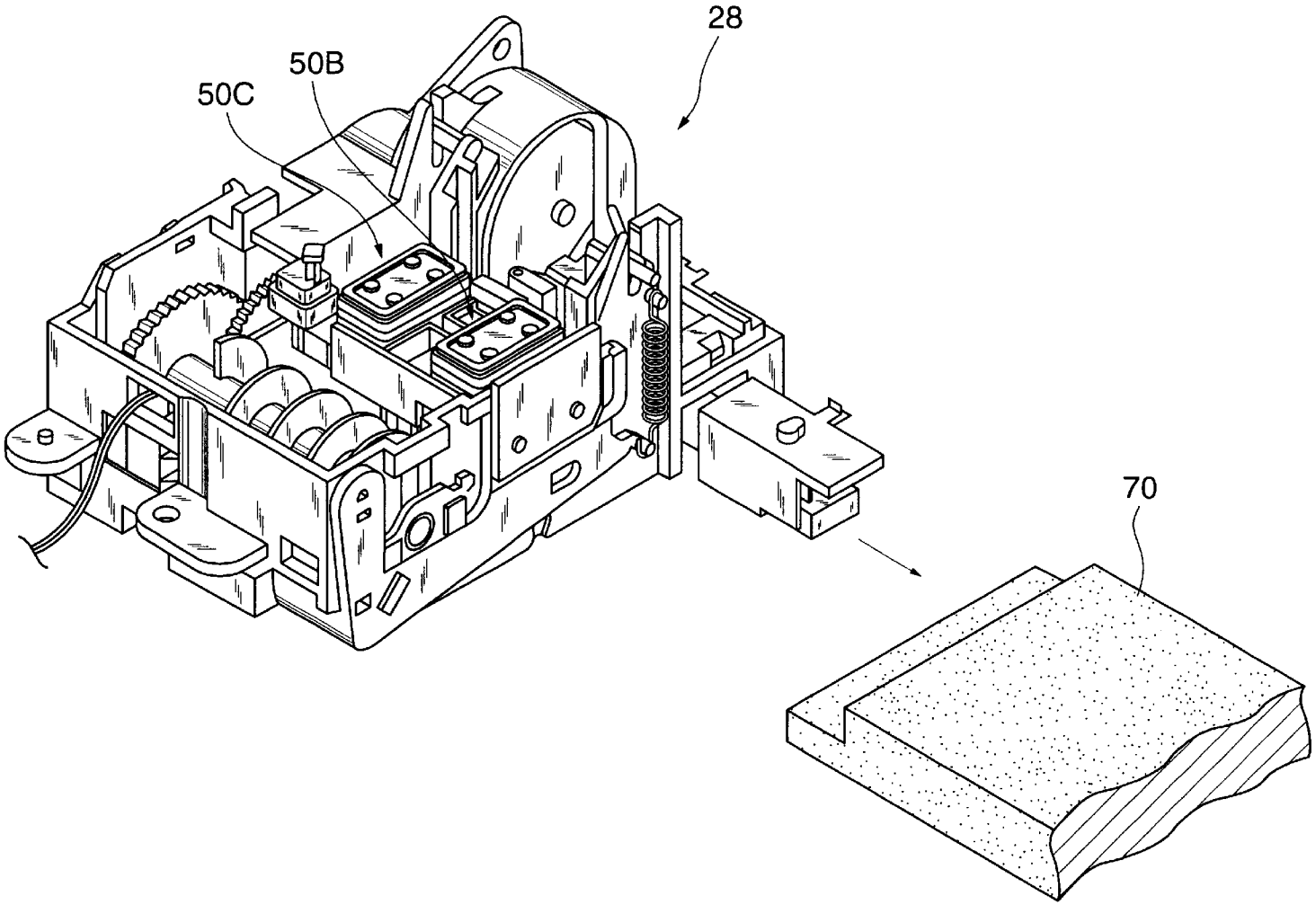
FIG. 2 is an enlarged perspective view of a maintenance part of the ink jet color recording apparatus according to the first embodiment of the invention.

As shown in FIG. 1, a first embodiment of an ink jet color recording apparatus is provided with a recording head 22 (hereinafter referred to as head 22 simply) adapted to reciprocate along a guide 21 while injecting ink, a transport mechanism 26 for transporting recording paper P in the direction U intersecting perpendicularly to the reciprocating direction W, and a maintenance part 28 (see FIG. 2) for recovering the function of the head 22.

The head 22 has black pigment ink (hereinafter referred to as black ink) stored in a black ink storing container 32 and color dye ink (hereinafter referred to as color ink) stored in a color ink storing container 34.

Figure 3:
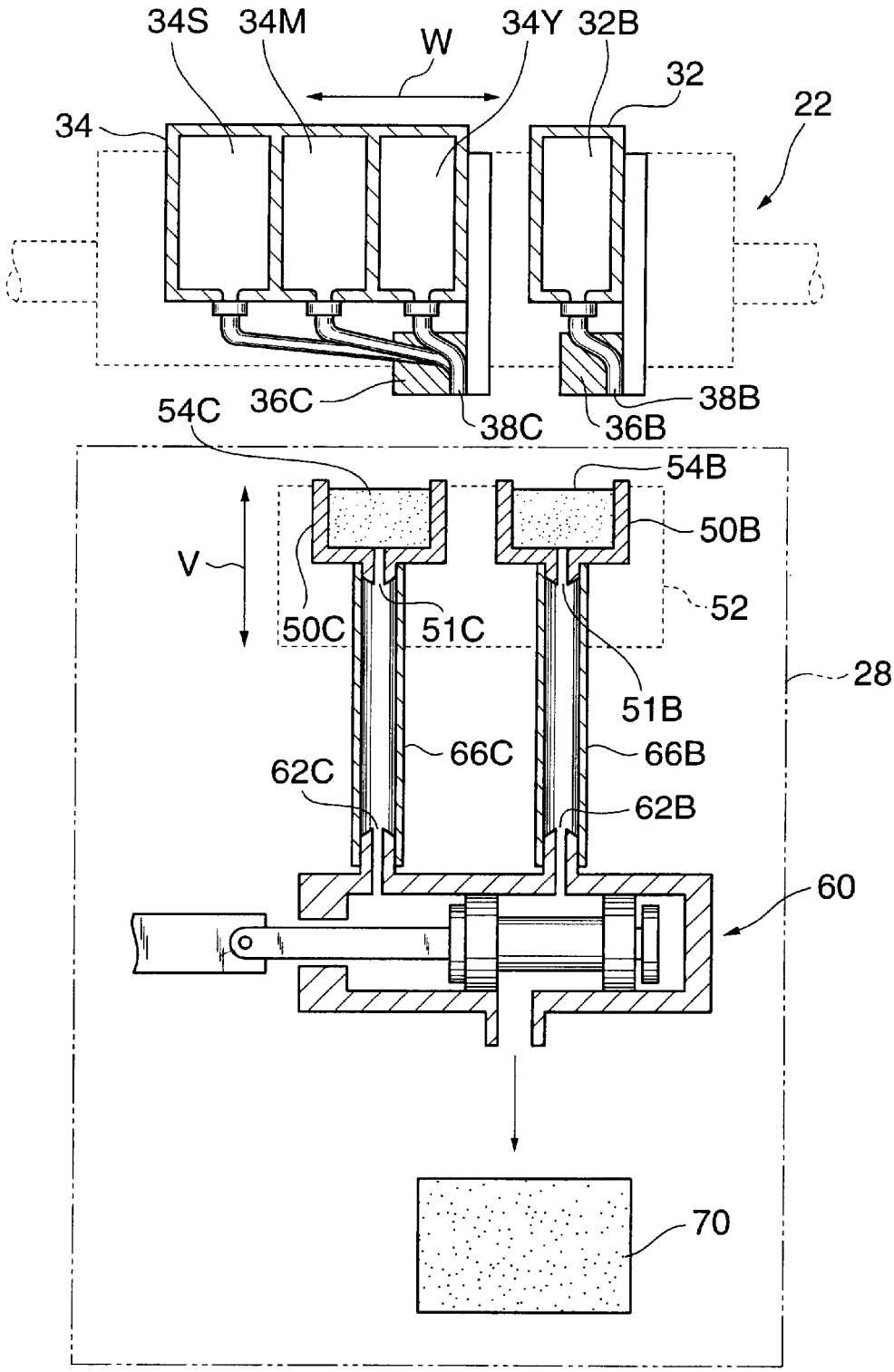
FIG. 3 is a sectional view showing the constitution of the ink jet color recording apparatus according to the first embodiment of the invention.

As shown in FIG. 3, the color ink storing container 34 is provided with storing parts 34Y, 34M, 34S for respectively storing color ink of yellow, magenta and cyan and a nozzle part 36C (hereinafter referred to as color nozzle part 36C) for discharging color ink fed from each storing part. A nozzle 38C for discharging color ink (hereinafter referred to as color nozzle 38C) is formed on the color nozzle part 36C.

A black ink storing container 32 is also similarly provided with a storing part 32B for storing black ink and a nozzle part 36B for discharging black ink (hereinafter referred to as black nozzle part 36B) fed from the storing part 32B, and a nozzle 38B for discharging black ink (hereinafter referred to as black nozzle part 38B) is formed on the black nozzle part 36B.

The color nozzle 38C and the black nozzle 38B are both constituted by forming plural nozzles in line.

On the other hand, a maintenance part 28 is so constructed that when an abnormal image is formed in recording paper P (see FIG. 1), ink clogging of the head 22 is eliminated by the maintenance part 28.

As shown in FIG. 3, the maintenance part 28 is provided with a black cap 50B and a color cap 50C which respectively collect black ink blank-discharged from the black nozzle part 36B and color ink blank-discharged from the color nozzle part 36C as a cap member, and both caps are both held on a cap carriage 52 with an opening thereof upward. The cap carriage 52 is capable of moving in the vertical direction V.

The black cap 50B and the color cap 50C respectively accommodate a sponge body 54B and a sponge body 54C for absorbing ink and retaining it.

Further, the maintenance part 28 includes a suction pump 60 disposed below the black cap 50B and the color cap 50C for discharging ink. An ink discharge port 51B formed in the cap bottom of the black cap 50B and a first suction port 62B of the suction pump 60 are connected to each other by a hose 66B, and sucked ink is discharged and absorbed in a discharged ink absorber 70. Similarly in the color cap 50C, an ink discharge port 51C of the cap bottom and a second suction port 52C of the suction pump 60 are connected to each other by a hose 66C.

When an abnormal image is formed on recording paper P (see FIG. 1), a user of the ink jet color recording apparatus 20 gives the command of maintenance on the black nozzle part 36B to the apparatus 20. In response to the command, according to the procedure of the flowchart shown in FIG. 4, the maintenance on the black nozzle part 36B is performed.

First, the instruction that black ink is sucked is given from the ink jet color recording apparatus 20. Consequently the head 22 is moved to locate the black nozzle part 36B right above the black cap 50B and stopped, and further the cap carriage 52 is moved upward so that the black cap 50B is sealed by the black nozzle part 36B (see FIG. 5).

Figure 4:
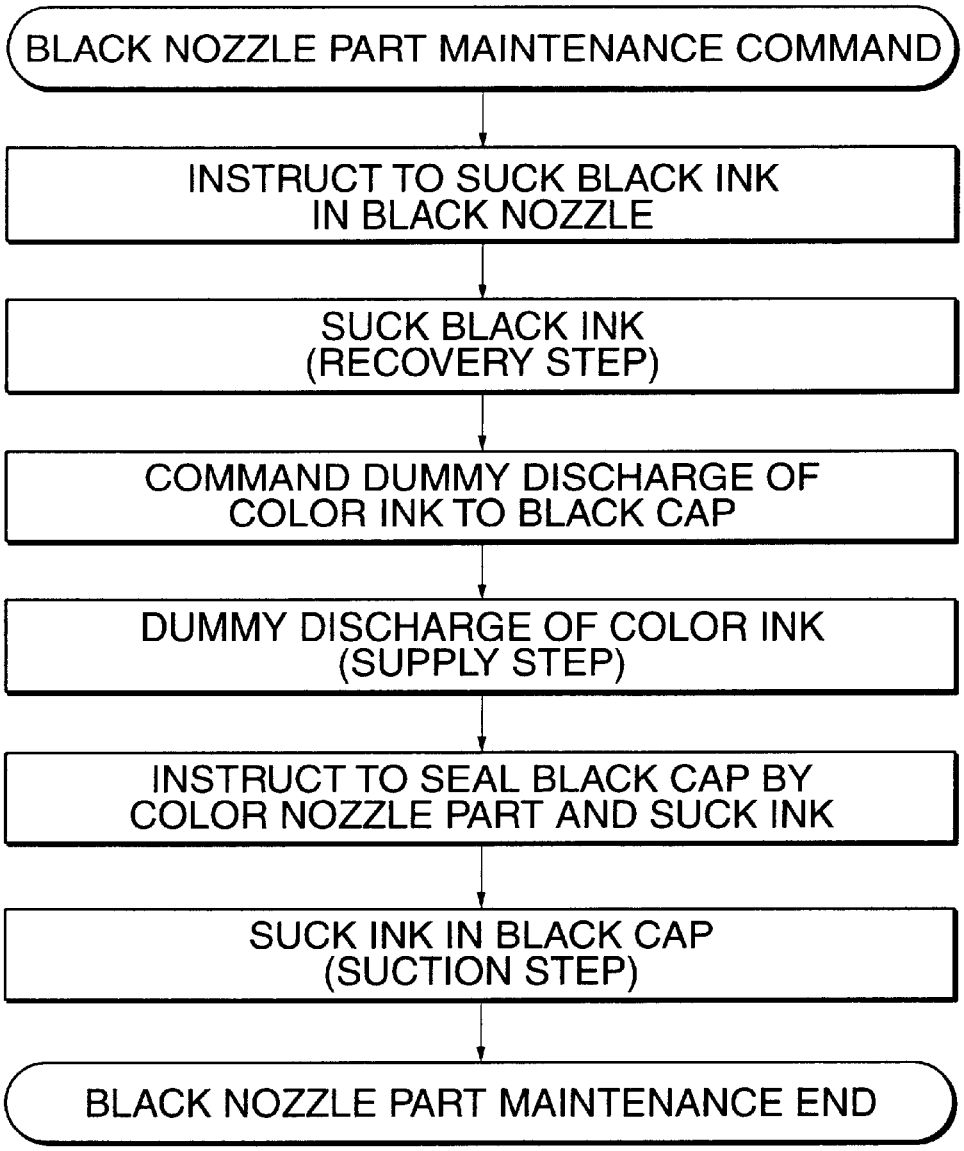
FIG. 4 is a flowchart showing the procedure of performing maintenance on a nozzle in the first embodiment.
Figure 5:
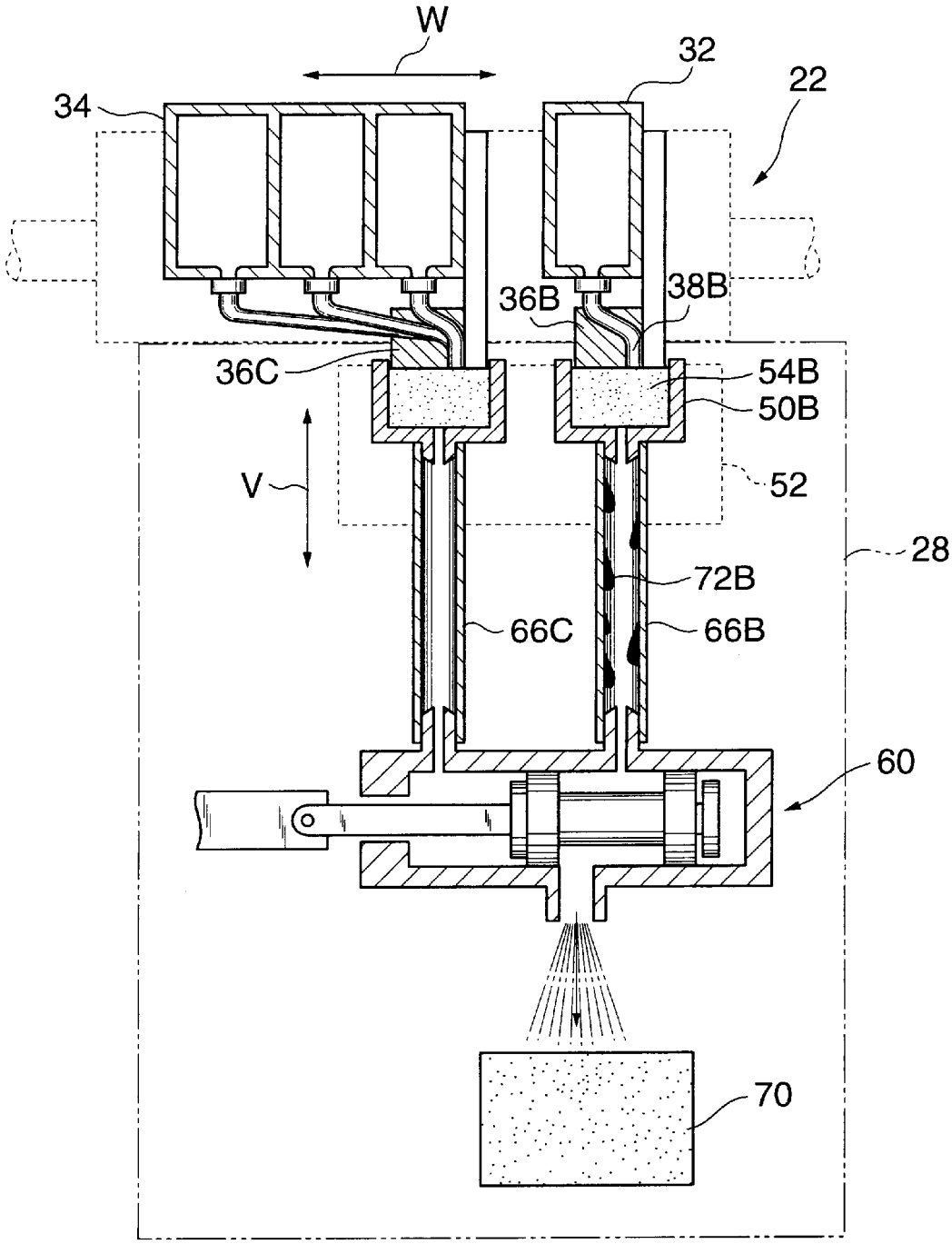
FIG. 5 is a sectional view showing the condition where black ink in a black nozzle is sucked and discharged in the first embodiment.

Subsequently, by the suction operation of the suction pump 60, black ink in the black nozzle 38B is discharged through the black cap 50B, the hose 66B and further the suction pump 60 (recovery step of FIG. 4), and absorbed in the discharged ink absorber 70. In the state of ending the recovery step, as shown in FIG. 5, residue of black ink (hereinafter referred to as black ink residue) remains in the sponge body 54B, and also black ink residue 72B adheres to the inner all of the hose 66B.

After the end of the recovery step, the black cap 50*b* is opened to the air, and the cap carriage 52 is moved downward to return to its original position.

Figure 6:
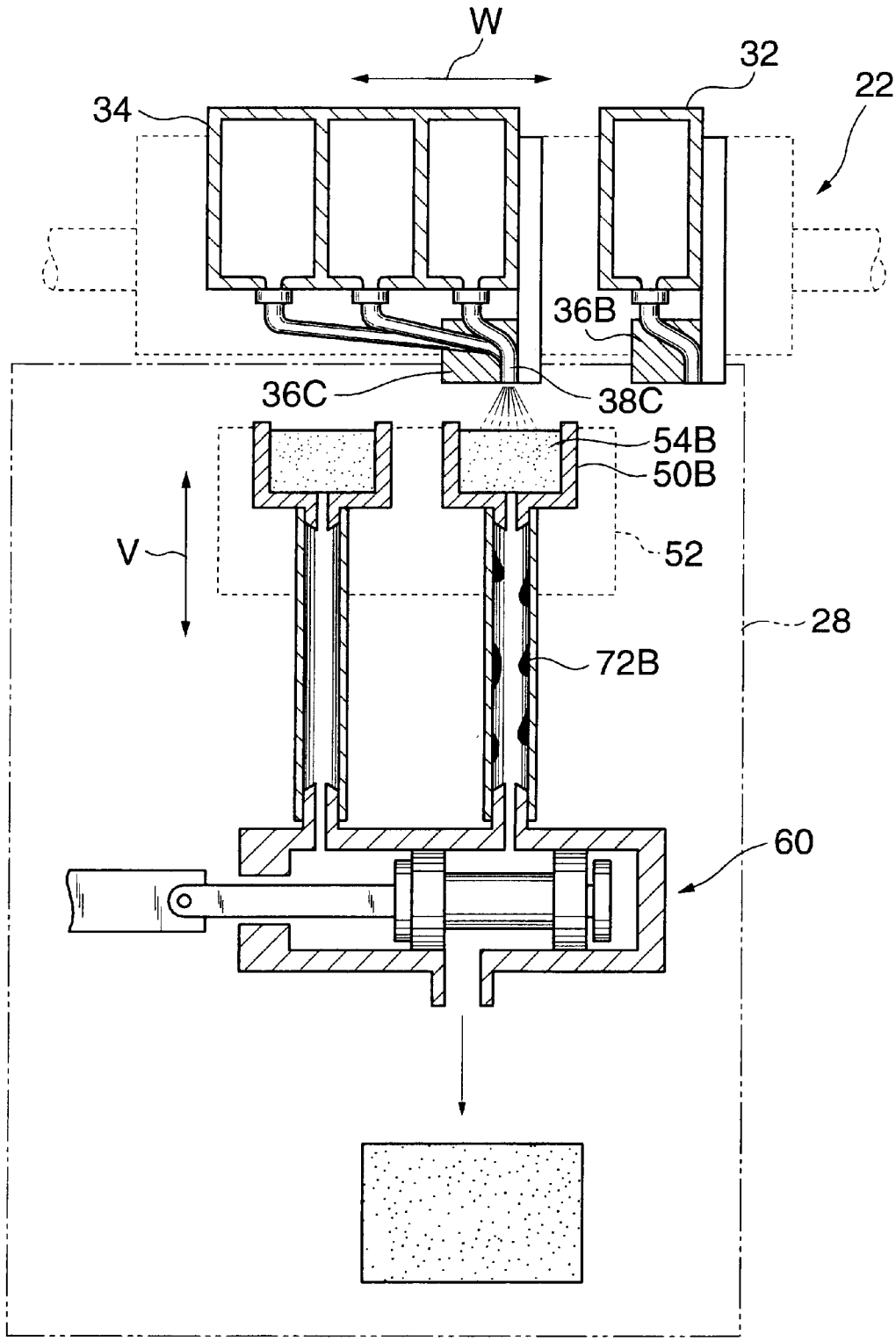
FIG. 6 is a sectional view showing that color ink is blank-discharged to a black cap in the first and second embodiments.

Next, the instruction that color ink is blank-discharged to the black cap 50B is given. Consequently, the head 22 is moved to locate the color nozzle 38C in the center of the black cap 50B and stopped, and subsequently, as shown in FIG. 6, color ink which is dye ink is blank-discharged from the color nozzle 38C (supply step of FIG. 4). The blank discharge amount is set to a suitable amount in advance.

The blank-discharged color ink is absorbed in the sponge body 54B, and the black ink residue in the sponge body 54*b* is mixed with the color ink to become mixed ink. The mixed ink is hard to dry in the sponge body 50B because the density of black ink is low.

Figure 7:
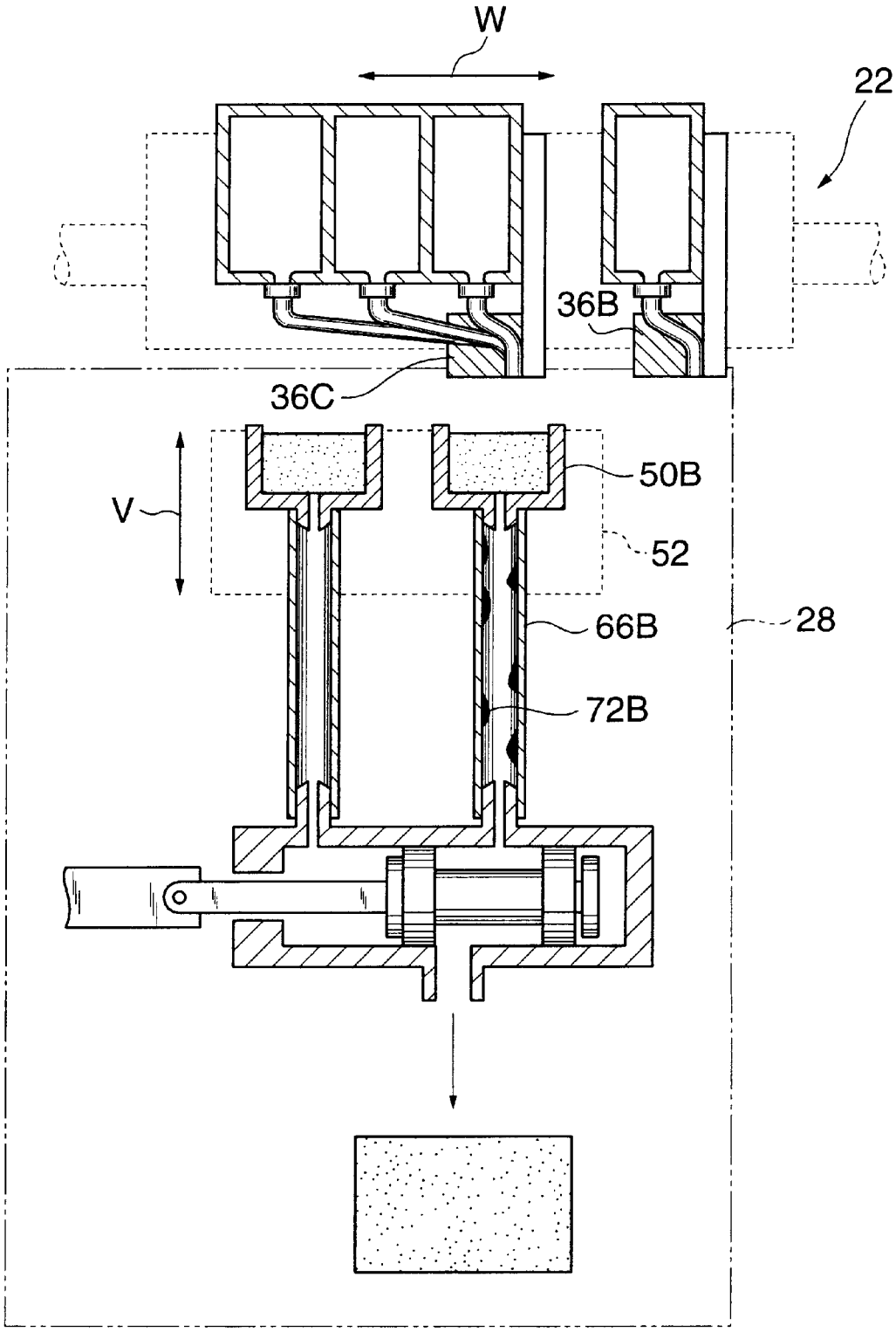
FIG. 7 is a sectional view showing the condition where a color nozzle part is positioned right over the black cap in the first and second embodiments.

Further, given is the instruction that the black cap 50B is sealed by the color nozzle part 36C to absorb ink. Consequently, as shown in FIG. 7, the head 22 is a little moved to locate the color nozzle part 36C right above the black cap 50B and stopped.

Figure 8:
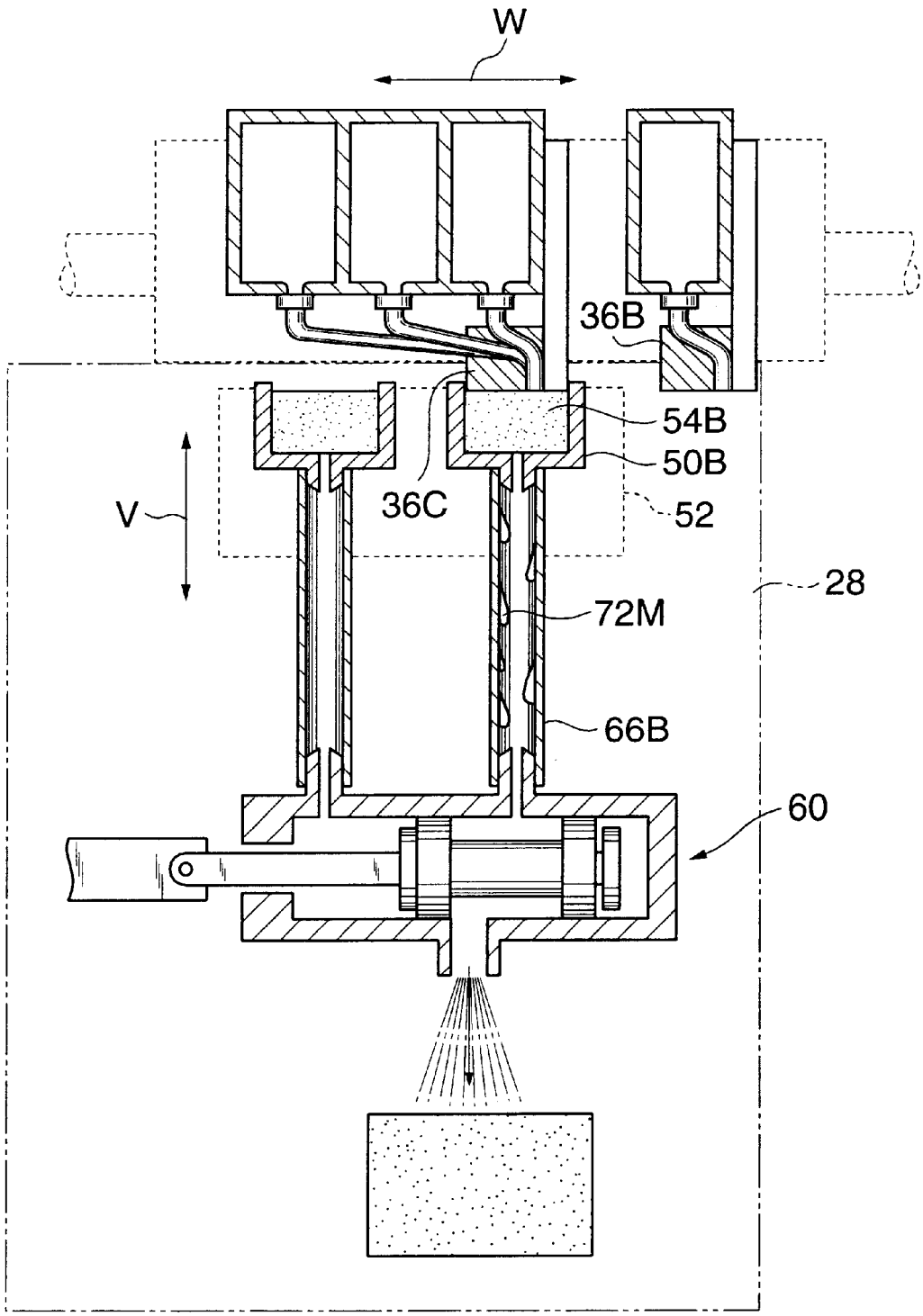
FIG. 8 is a sectional view showing that mixed ink staying in the black cap is sucked and discharged in the first and second embodiments.

The cap carriage 52 is moved upward, and the black cap 50B is sealed by the color nozzle part 36C (see FIG. 8).

Subsequently, the mixed ink absorbed in the sponge body 54B is absorbed through the hose 66B and the black cap 50B by the suction pump 60 (suction step of FIG. 4).

Thus, the mixed ink is removed from the sponge body 54B, and the black ink residue 72B (FIGS. 5 to 7) adhering to the inner wall of the hose 66B is diluted with the mixed ink and simultaneously sucked and discharged. Accordingly, the ink adhering to the inner wall of the hose 66B becomes mixed ink residue 72M instead of the black ink residue 72B (see FIG. 8).

The mixed ink residue 72M is hard to dry because the density of black ink is low.

Since the black ink is sucked from the sponge body 54B by the recovery step in the first embodiment, the supply amount of color ink supplied at the supply step may be remarkably smaller as compared with that in a second embodiment to be mentioned later.

A second embodiment will now be described. The ink jet color recording apparatus of the second embodiment is so constructed that as maintenance on the nozzle, ink (especially black ink which is pigment ink) is periodically and automatically blank-discharged from the nozzle to prevent clogging of the nozzle. The apparatus is different from the first embodiment of the ink jet color recording apparatus 20 (see FIGS. 1 to 3) in command in performing maintenance, but they have the basically same components. Therefore, in the second embodiment, the same reference numerals designate the same components as those of the first embodiment, so the description will be omitted.

Figure 9:
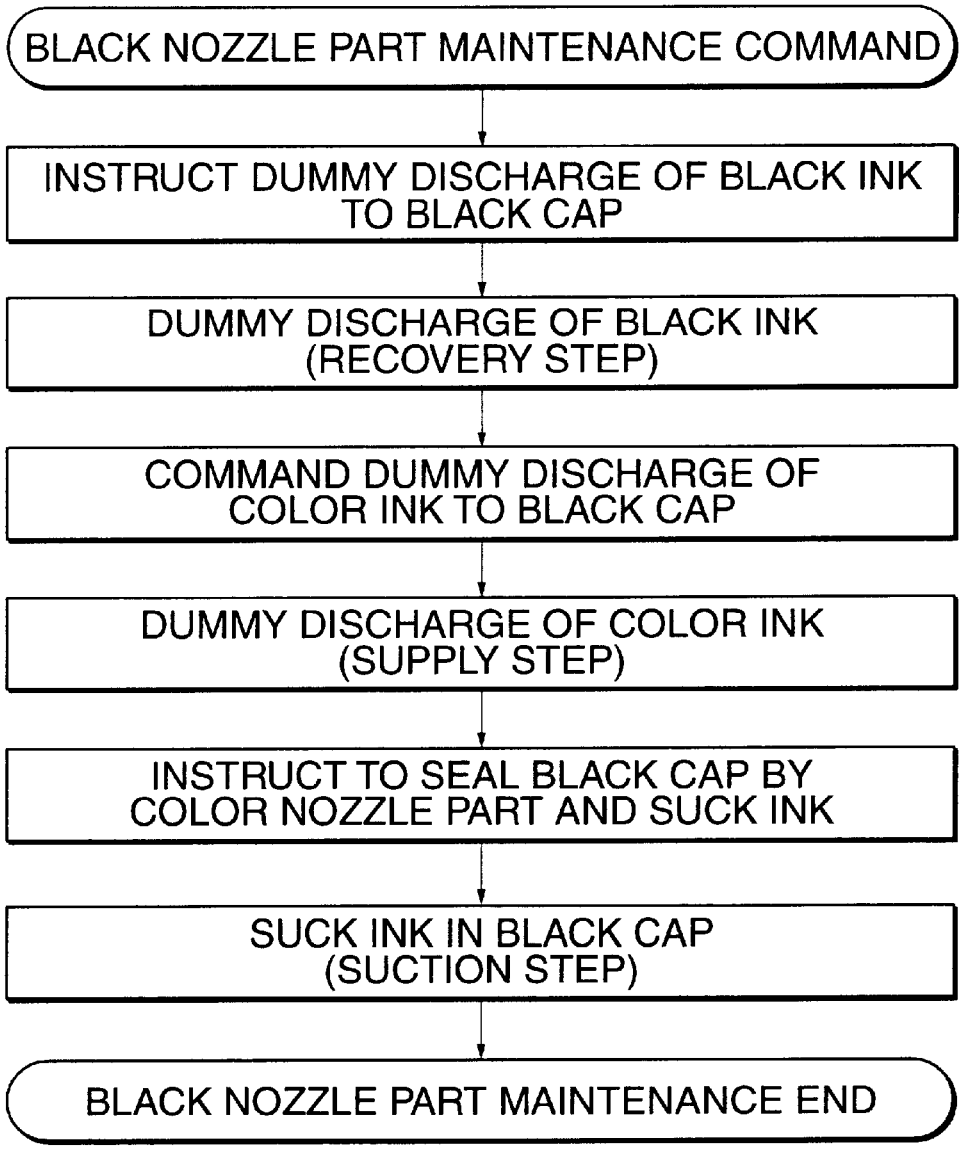
FIG. 9 is a flowchart showing the procedure of performing maintenance on a nozzle in the second embodiment.

The following description deals with the operation at the time of giving the command (periodic command) that black ink is blank-discharged from the black nozzle part 36B from the ink jet color recording apparatus of the second embodiment as maintenance on the nozzle as shown in FIG. 9.

Figure 10:
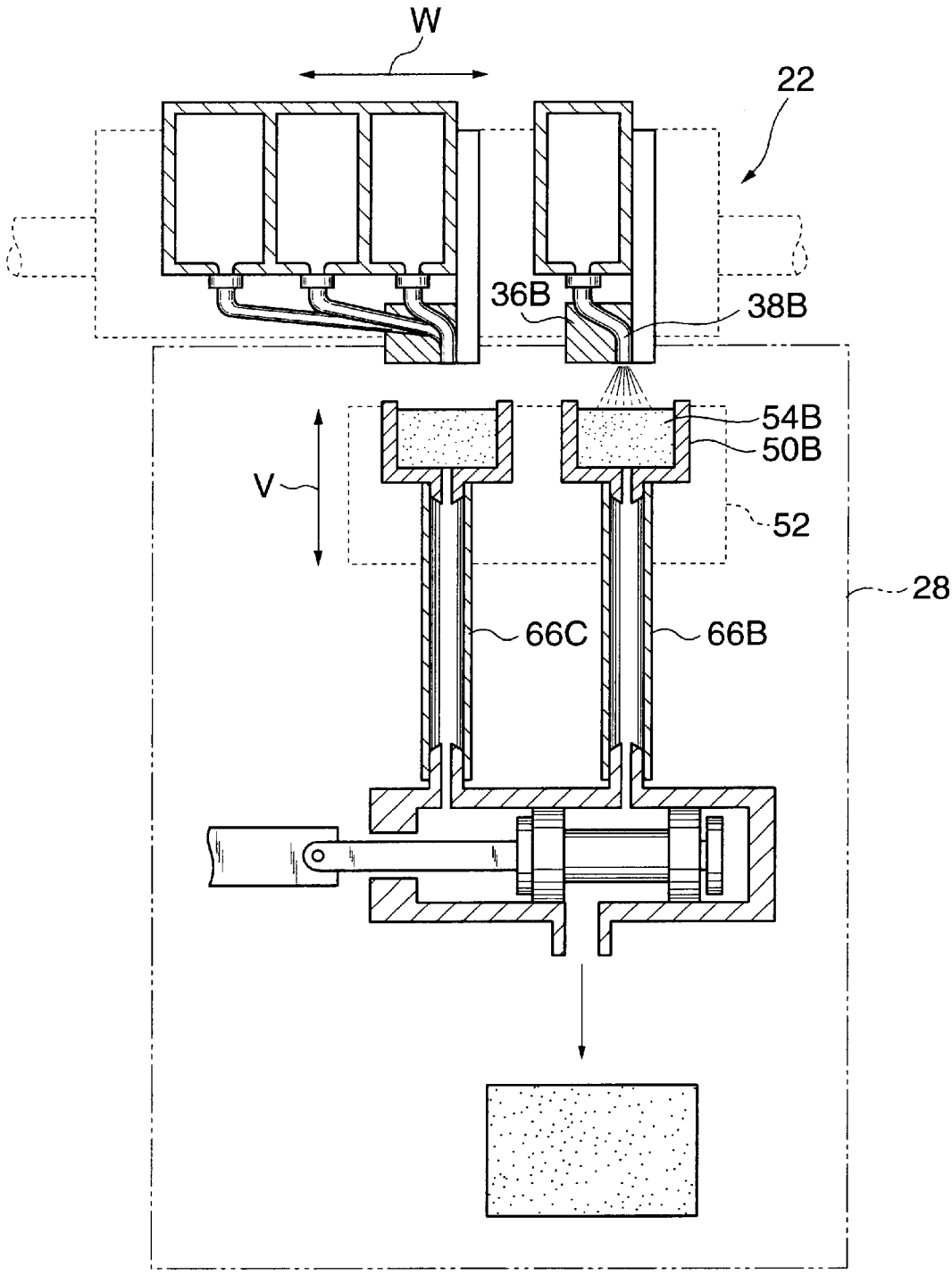
FIG. 10 is a sectional view showing that black ink is blank-discharged to the black cap in the second embodiment.
Figure 11:
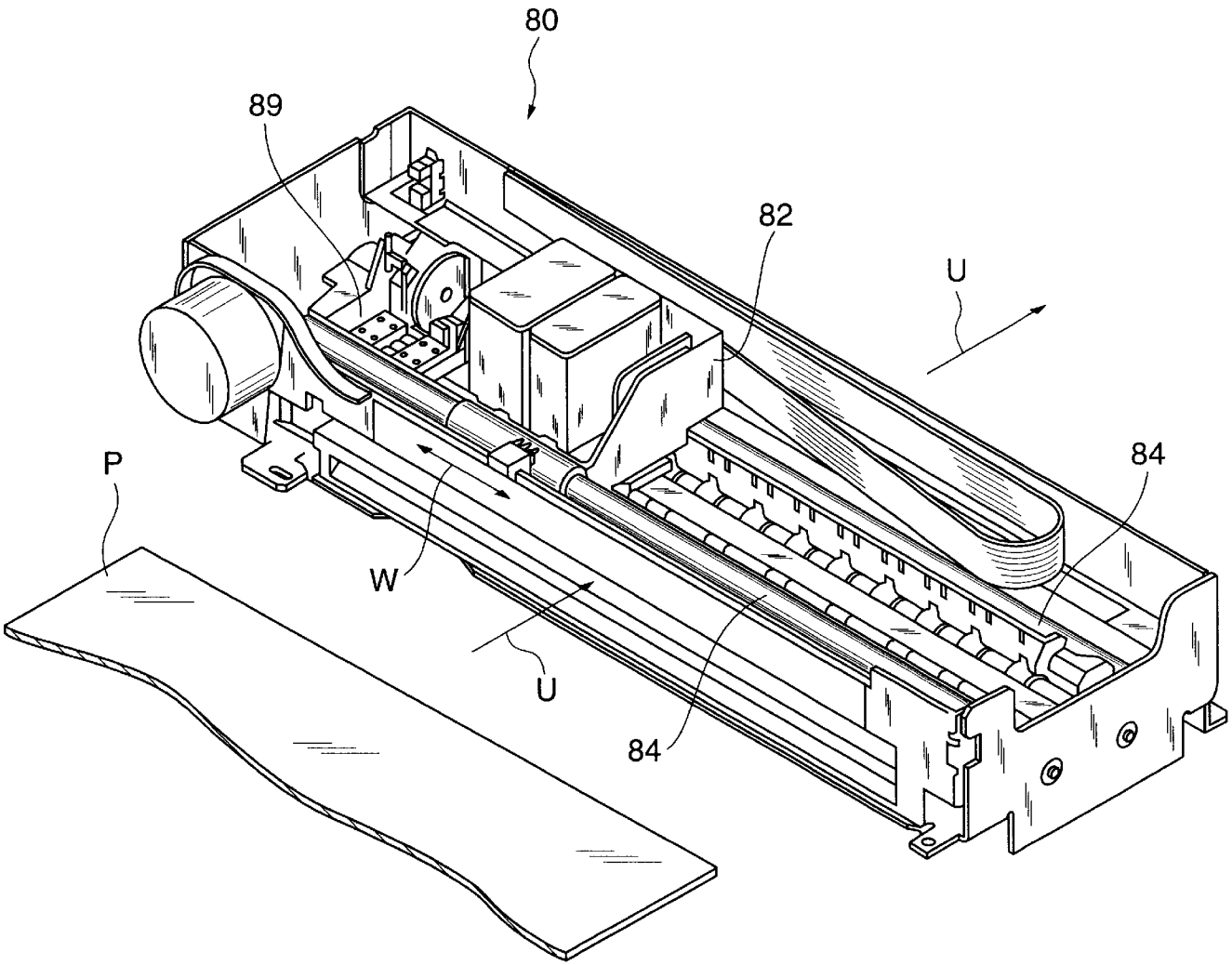
FIG. 11 is a perspective view of the conventional ink jet color recording apparatus.
Figure 12:
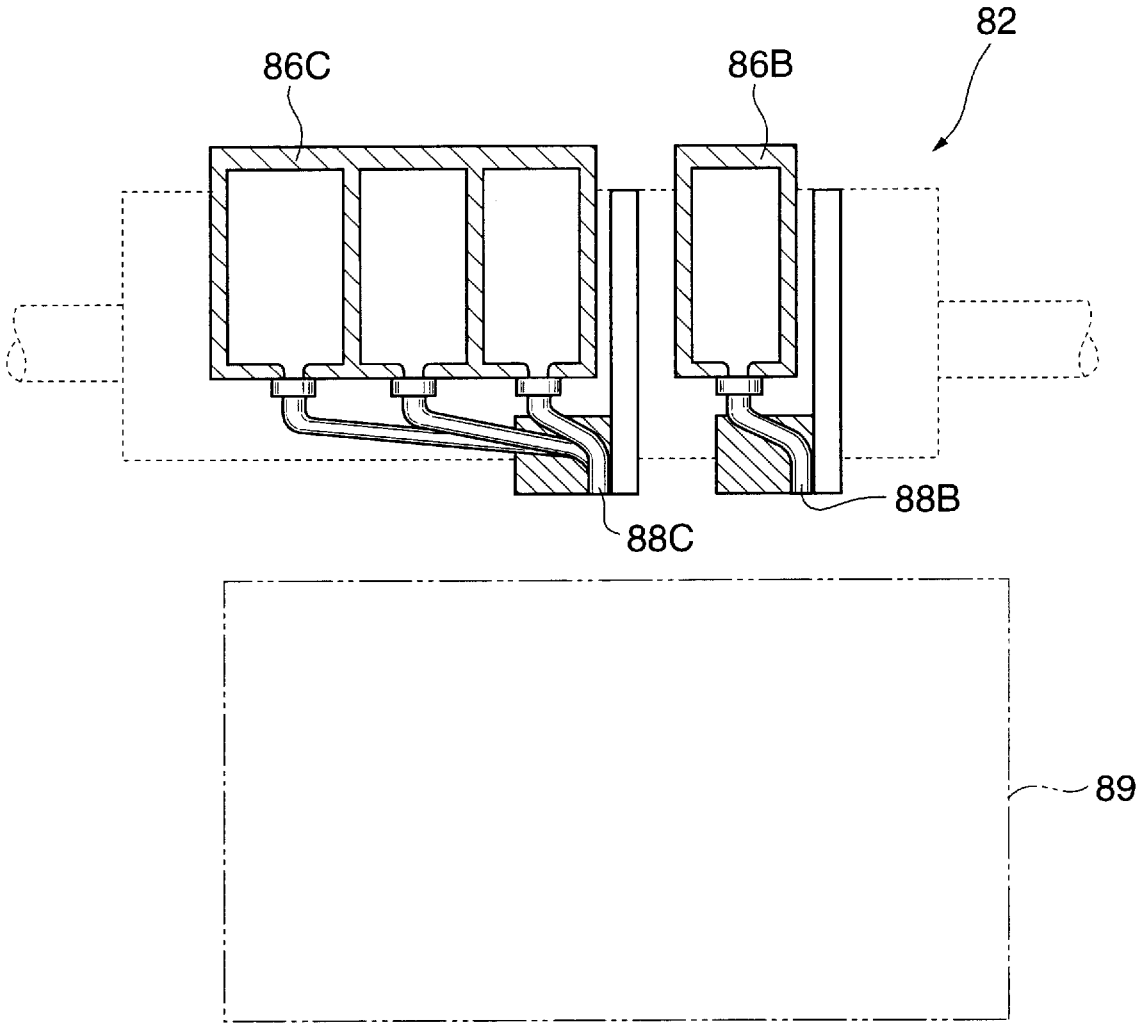
FIG. 12 is a sectional view showing the constitution of the conventional ink jet color recording apparatus.
Figure 13:
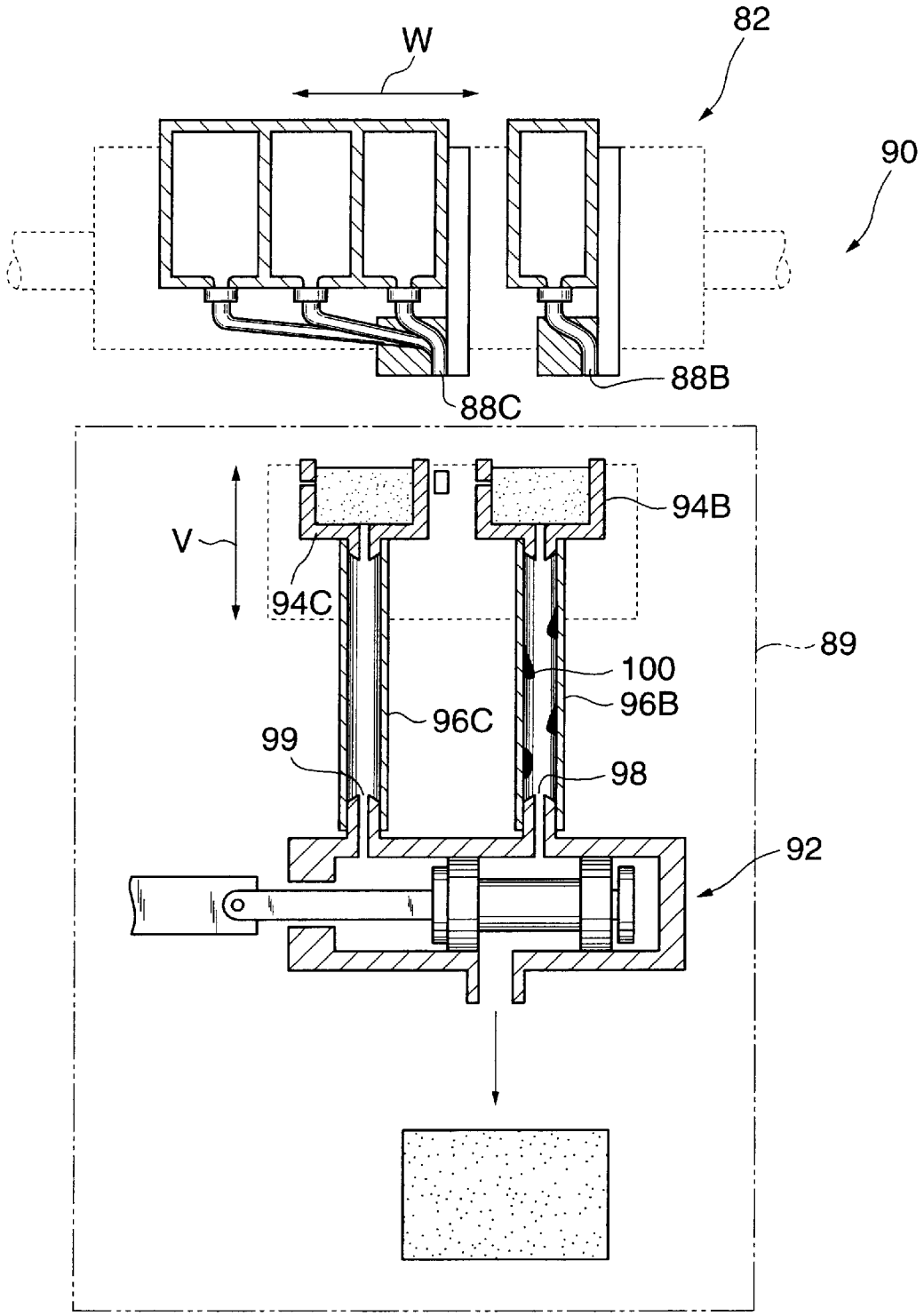
FIG. 13 is a sectional view showing the constitution of the conventional ink jet color recording apparatus.

When this command is given, first, the black ink blank discharge instruction is given. Consequently, as shown in FIG. 10, the head 22 is moved to locate the black nozzle 38B right above the black cap 50B and stopped, and further black ink (pigment ink) is blank-discharged from the black nozzle 38B (recovery step of FIG. 9). The blank discharge amount of black ink is set to a suitable amount in advance.

The blank-discharged black ink is absorbed in the sponge body 54B.

Secondly, the instruction that color ink is blank-discharged to the black cap 50B is given. Consequently, the head 22 is moved to locate the color nozzle 38C at the center of the black cap 50B and stopped, and subsequently, as shown in FIG. 6, color ink which is dye ink is blank-discharged from the color nozzle 38C (supply step of FIG. 9). The blank-discharged color ink is absorbed in the sponge body 54B of the black cap 50B.

Thus, the black ink (pigment ink) absorbed in the sponge body 54B is mixed with color ink (dye ink) to lower the density, so that the mixed ink hard to dry is made. The blank discharge amount of color ink is set in advance to a suitable amount so that the black ink density in the mixed ink is equal to or lower than a designated density.

After that, given is the instruction that the black cap 50B is sealed by the color nozzle part 36C to absorb ink. Consequently, the head 22 is a little moved to locate the color nozzle part 36C right above the black cap 50B and stopped (see FIG. 7).

Then, the cap carriage 52 is moved upward, and the black cap 50B is sealed by the color nozzle part 36C (see FIG. 8).

Subsequently, the mixed ink staying in the sponge body 54B is sucked through the hose 66B and the black cap 50B by the suction pump 60 (suction step of FIG. 9).

Since this mixed ink is hard to dry, the mixed ink residue 72M adhered to the inner wall of the hose 66B by the suction is hard to be solidified. Accordingly, the function of the maintenance part 28 can be kept sufficiently.

Though the description of the first and the second embodiments deals with maintenance on the black nozzle part 36B only, the ink jet color recording apparatus described in the embodiments of the invention is adapted to also perform maintenance on the color nozzle part 36C.

In performing maintenance on the color nozzle part 36C, color ink is periodically blank-discharged from the color nozzle part 36C toward the color cap 50C (see FIG. 3). The blank-discharged color ink is absorbed in the sponge body 54C of the color cap 50C. After that, the color cap 50C is sealed by the color nozzle part 36C, and the color ink absorbed in the sponge body 54C is sucked and discharged through the hose 66C by the suction pump 60.

Since black ink (pigment ink) will not be discharged to the color cap 50C, it is not necessary to fear that ink may be rapidly solidified in the color cap 50C or on the inner wall of the hose 66C (see FIG. 3).

The entire disclosure of Japanese Patent Application No. 2000-65974 filed on Mar. 10, 2000 including specification, claims, drawings and abstract is incorporated herein by reference in its entirety.

What is claimed is:

1. A method for recovering ink-jet recording head comprising the steps of: vacuuming a pigment-base liquid ink from a nozzle into a cap member having an ink guide tube;

supplying a dye-base liquid ink into the ink guide tube through the cap member;

mixing the dye-base liquid ink and the pigment-base liquid ink to form a mixed liquid with a density lower than the pigment-base liquid ink, thereby preventing the ink in the cap member and the ink guide tube from solidifying; and sucking the mixed liquid to purge the cap member and the ink guide tube.

2. An ink-jet recording apparatus comprising:

a recording head having a nozzle for injecting a pigment-base ink;

a cap member for recovering the pigment-base ink in the nozzle;

an ink guide tube connected to the cap member; and an ink supplying device that supplies a dye-base ink into the ink guide tube through the cap member, so that the dye-base ink is mixed with the pigment-base ink in both the cap member and the ink guide tube to form a mixed ink with a density lower than the pigment-base ink, thereby preventing the ink in the cap member and the ink guide tube from solidifying, wherein the cap member the ink guide tube are purged by sucking the mixed ink.

3. The ink-jet recording apparatus according to claim 2, wherein the ink supplying device is a second recording head having a nozzle for injecting the dye-base ink.

4. An ink jet color recording apparatus, comprising:

a plurality of ink tanks for respectively storing inks which includes at least a first ink and a second ink, the first and second inks being different in composition from each other;

at least two recording heads having a first nozzle for injecting the first ink and a second nozzle for injecting the second ink;

a cap member for recovering the first ink in the first nozzle;

an ink guide tube connected to the cap member; and a purging mechanism for purging the cap member and the ink guide tube by supplying the second ink from the second nozzle into the cap member to mix the second ink with the first ink to form a mixed ink with a density lower than the first ink, thereby preventing the ink in the cap member and the ink guide tube from solidifying.

5. The ink jet color recording apparatus according to claim 4, wherein the first ink is a pigment ink and the second ink is a dye ink.

6. The ink jet color recording apparatus according to claim 4, further comprising a pump for sucking the inks from the nozzles.

7. The ink jet color recording apparatus according to claim 6, wherein the first ink is mixed with the second ink to form a mixed ink and the pump sucks the mixed ink.

8. The ink jet color recording apparatus according to claim 4, wherein the first ink is blank-injected from the first nozzle.

* * * * *